United States Patent [19]

Kunda

[11] 4,331,469

[45] May 25, 1982

[54] PROCESS FOR THE RECOVERY OF SILVER VALUES FROM SILVER-CONTAINING MATERIAL WHICH ALSO CONTAINS IRON AND ARSENIC

[75] Inventor: Wasyl Kunda, Edmonton, Canada

[73] Assignee: Sherritt Gordon Mines Limited, Toronto, Canada

[21] Appl. No.: 179,613

[22] Filed: Aug. 19, 1980

[30] Foreign Application Priority Data

May 30, 1980 [CA] Canada ..... 353083

[51] Int. Cl.[3] ..... C22B 11/04

[52] U.S. Cl. ..... 75/0.5 A; 75/118 R; 75/83; 423/34; 423/37; 423/87; 423/140; 423/150

[58] Field of Search ..... 423/27, 37, 34, 35, 423/83, 87, 37; 75/118 P, 118 R, 0.5 A

[56] References Cited

U.S. PATENT DOCUMENTS

| | | | |
|---|---|---|---|
| 1,071,290 | 8/1913 | Birkeland | 423/87 |
| 1,119,473 | 12/1914 | Thacher | 423/27 |
| 1,150,787 | 8/1915 | Rankin | 75/101 R |
| 3,929,466 | 12/1975 | Moynohan | 75/118 P |
| 3,965,239 | 6/1976 | Posel | 423/150 |
| 4,038,361 | 7/1977 | Posel | 423/41 |
| 4,084,961 | 4/1978 | Caldon | 75/118 R |
| 4,118,243 | 10/1978 | Sandesara | 423/87 |
| 4,123,499 | 10/1978 | Welsh | 423/140 |

OTHER PUBLICATIONS

*Chem. Abstracts*, vol. 67,(1967), No. 76,772g.

Masterton et al., *Chemical Principles*, W. B. Saunders Co., Phila., Pa., (1967), p. 404.

*Primary Examiner*—Brian E. Hearn

*Attorney, Agent, or Firm*—Robert F. Delbridge; Arne I. Fors

[57] ABSTRACT

A process for the recovery of silver values from silver-containing material which also contains iron and arsenic includes leaching the material under oxidizing conditions at elevated temperature and pressure in aqueous nitric acid solution to dissolve a substantial amount of silver together with substantial amounts of arsenic, iron and other metals if present. The resultant leach solution is separated from undissolved leach residue and treated with a solution containing chloride ions to selectively precipitate substantially all dissolved silver as silver chloride without significant co-precipitation of other dissolved metals. The silver chloride precipitate is then separated from the remaining solution.

8 Claims, 1 Drawing Figure

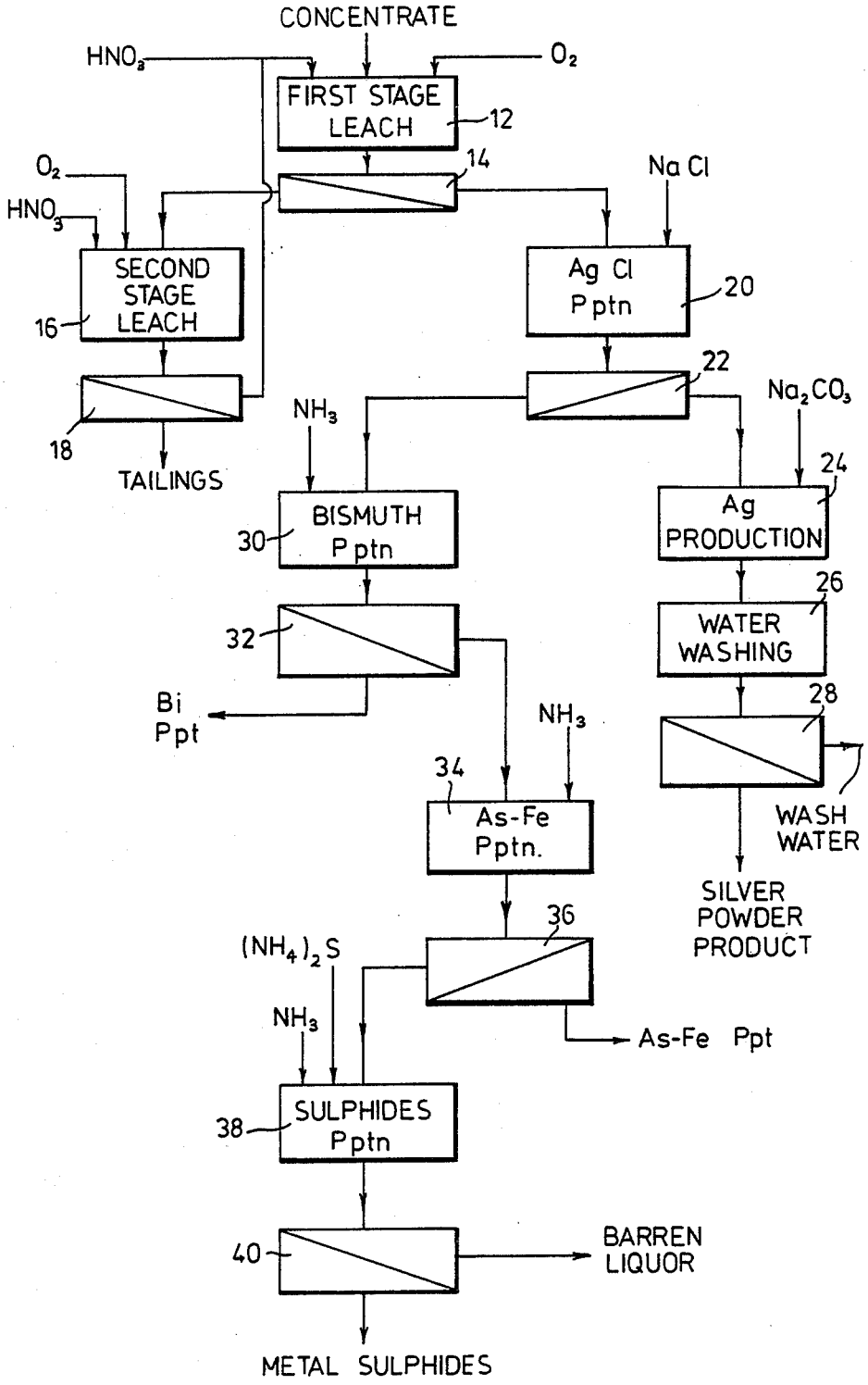
CONCENTRATE
HNO3
O2
FIRST STAGE LEACH
12
14
O2
HNO3
Na Cl
SECOND STAGE LEACH
16
Ag Cl Pptn
20
22
18
TAILINGS
NH3
Na2CO3
24
BISMUTH Pptn
30
Ag PRODUCTION
26
32
WATER WASHING
Bi Ppt
28
NH3
34
As-Fe Pptn.
WASH WATER
SILVER POWDER PRODUCT
36
(NH4)2S
NH3
As-Fe Ppt
SULPHIDES Pptn
38
40
BARREN LIQUOR
METAL SULPHIDES

PROCESS FOR THE RECOVERY OF SILVER VALUES FROM SILVER-CONTAINING MATERIAL WHICH ALSO CONTAINS IRON AND ARSENIC

This invention relates to the recovery of silver values from silver-containing material which also contains arsenic and iron. Such material may be of a sulphidic nature, and may contain elemental silver and/or silver sulphides together with sulphides and arsenides of iron and other metals such as nickel and cobalt. Sulphides of other metals such as copper, zinc, lead and bismuth are also frequently present in such complex material.

Material of this kind is usually in the form of a silver concentrate, and such concentrate has in the past usually been treated by pyrometallurgical methods. However, due to environmental regulations, only concentrates of relatively low arsenic content can now be treated in this manner. Further, silver produced from such complex concentrates by pyrometallurgical methods may be contaminated by other metals such as nickel, cobalt and copper to an extent which is not commercially acceptable.

Since silver is an important metal, it would be desirable if a satisfactory alternative method could be found for recovering silver values from complex silver concentrates which contain arsenic and iron and possibly other metals. Some silver is recovered by hydrometallurgical methods from residues of leaching processes used in the recovery of metals such as nickel, copper and cobalt from material containing these metals and silver. It would clearly be advantageous if a hydrometallurgical method could be found for recovering silver values from complex arsenious silver concentrates. However, so far as applicant is aware, no suitable hydrometallurgical method for this purpose is known.

According to the present invention, it has been discovered that silver values substantially free from contamination by arsenic and other elements can be recovered from a complex arsenious iron-containing silver concentrate by leaching the concentrate in an aqueous nitric acid solution at elevated temperature and pressure to dissolve silver, arsenic and iron together with other metals such as bismuth, nickel, cobalt, copper and zinc if present, separating the resultant leach solution from undissolved residue and treating the leach solution with a chloride solution to precipitate silver values as silver chloride without significant precipitation of other metal values.

Surprisingly, although the strong leaching of the concentrate which is necessary to dissolve a substantial amount of silver from the complex compounds in the concentrate also dissolves arsenic and other metals, the treating of the leach solution with chloride ions precipitates substantially all the dissolved silver as silver chloride but does not coprecipitate any substantial amount of dissolved arsenic or other metals. In other words, it is not necessary to purify the leach solution by removing dissolved arsenic or other metals before recovering the silver values as silver chloride.

The amount of nitric acid used in the leaching step should be sufficient to provide nitrate ions at least stoichiometrically equivalent to the dissolved metal ions in the leach solution. Since sulphur present in sulphidic compounds in the starting material may be partially oxidized to form sulphate ions during the leach step, the presence of such sulphates ions will reduce the nitric acid requirement.

The leach step is preferably carried out at a temperature in the range of from about 50° C. to about 125° C. Depending on the actual composition of the starting material, the metal dissolution will usually increase with temperature, although in some instances the silver dissolution may decrease at temperatures in the upper part of this range, it being believed that this is due to the formation of insoluble silver jarosite. It is also believed that the formation of such silver jarosite at the high temperatures is more likely when the starting material contains relatively high amounts of iron, sulphur and silver. It has been found however that the tendency for silver extraction to decrease with higher temperature in the case of some starting materials can be reduced by providing a higher nitric acid concentration.

The leach step should be carried out in the presence of oxygen to effect oxidation of arsenides to arsenates and the oxidation of sulphides to elemental sulphur or sulphates. Also, nitric oxide is produced during the leach, and may be oxidized by oxygen to nitrogen peroxide which dissolves in the aqueous solution to regenerate nitric acid. Nitric oxide produced during the leach may be recovered and oxidized to nitrogen peroxide in a separate step, for example, at atmospheric pressure, with the nitrogen peroxide being dissolved in aqueous solution to regenerate nitric acid.

The leach step should be carried out in a sealed autoclave with the oxygen pressure being sufficient to ensure availability of oxygen for the reactions which are to take place. The total pressure in the autoclave may be that generated by heating the autoclave, after sealing, to the desired reaction temperature. If the nitric acid is injected into the autoclave after it has been heated to the desired temperature, some cooling will probably be necessary since the reaction is exothermic. Where the starting material contains carbonates, the total pressure may be increased during the course of the reaction by the evolution of carbon dioxide.

Dissolution equilibrium is achieved relatively quickly, for example within about 30 to about 60 minutes, being faster at higher temperatures. Dissolved metal such as silver, iron, arsenic and bismuth may re-precipitate if the leaching step is continued beyond the time when maximum dissolution has occurred, and hence it is advisable to terminate the leaching step when maximum dissolution has been obtained.

In order to maximize the recovery of silver and other metals, it is advantageous to subject the residue from the first leach step to a second leach step under substantially the same conditions as the first leach step. However, in the second leach step, it may be advantageous to provide a greater amount of nitric acid to enhance dissolution of silver remaining in the residue as unreacted silver mineral or as silver jarosite. After separation, the second leach solution is advantageously recycled to the first leach step.

It was found that metal dissolution is not significantly affected by variations in pulp density, although it was noted that separation of the leach solution from undissolved residue was more difficult with higher pulp densities.

The leach solution from the leach step or from the first stage leach if two stages are used, is then treated with chloride solution to effect precipitation of silver values as silver chloride. The chloride solution may for example be sodium chloride solution or hydrochloric acid solution. It was found that substantially all silver values are precipitated by providing a slight stoichiometric excess of chloride ions without causing any significant co-precipitation of other dissolved metals. The silver chloride precipitate may have entrained impurities of other metals, but these can readily be removed by washing, for example with weak nitric acid solution.

After separation of the precipitated sodium chloride from the remaining leach solution, the sodium chloride may be converted to metallic silver. As a further feature of the invention, it has been found that the silver chloride may be satisfactorily converted to metallic silver by reaction with sodium carbonate at a temperature in the range of from about 500° to about 650° C., preferably about 600° C. It was found that the temperature should be over about 500° C. for the reaction to take place, but that the temperature should not be over about 650° C. as excessive sintering may occur above that temperature to produce a hard cake product. Below about 650° C., the product is readily broken up. Besides silver, which is produced as silver powder, the products of the reaction are sodium chloride, carbon dioxide and oxygen. The sodium chloride and any excess sodium carbonate may readily be removed by washing with water.

After silver removal, the remaining leach solution may be treated for the recovery of other dissolved metals. At this stage, the leach solution is very acidic. If the solution contains dissolved bismuth, it has been found that the dissolved bismuth can be selectively precipitated if the pH is raised to a value in the range of from about 0.4 to about 0.8. The increase in pH may be achieved by the addition of ammonia, and the dissolved bismuth precipitates as bismuth oxychloride and/or bismuth hydroxide depending on the presence or absence of chloride ions in the solution. The bismuth precipitate can then be separated from the solution. Thus, the dissolved bismuth can be selectively precipitated without causing any substantial co-precipitation of dissolved iron, arsenic, nickel, cobalt, copper or zinc. If lead is present in the original starting material, most of the lead will remain undissolved by the nitric acid leach and will remain in the leach residue. However, a minor amount of lead may be present in the solution as lead sulphate and, if so, may be co-precipitated with the bismuth.

Further, it has also been found that dissolved iron and arsenic can be precipitated from the remaining solution without causing any substantial co-precipitation of other dissolved metals such as nickel, copper, cobalt or zinc if the pH is then raised, for example, by additional ammonia, to a value in the range of from about 0.8 to about 1.8. The iron-arsenic precipitate will primarily be iron arsenate. This is a relatively safe non-toxic compound, and therefore the arsenic is effectively disposed of by this means. Where lead is present in the solution, some lead may be co-precipitated with the iron and arsenic.

After the iron-arsenic precipitate has been separated from the solution, nickel, cobalt, copper and zinc compounds can be co-precipitated by increasing the pH above about 1.8. However, it has been found that this method is not particularly suitable since such compounds tend to redissolve. Advantageously, these dissolved metals are co-precipitated as mixed sulphides by treatment with ammonium sulphide, hydrogen sulphide or an alkali metal sulphide at a pH of from about 5 to about 7, with the pH being raised to this value for example by the addition of ammonia and the sulphide. The mixed sulphide product can be treated in known manner for separate recovery of the metals contained therein.

BRIEF DESCRIPTION OF THE DRAWING

One embodiment of the invention will now be described, by way of example, with reference to the accompanying drawing, which shows a flow diagram for the treatment of complex silver concentrate.

Referring to the drawing, a complex silver concentrate containing, in addition to silver, bismuth, arsenic, iron, nickel, cobalt, copper and zinc in the form of native elements, sulphides or arsenides, is subjected to a first stage leach 12 in aqueous nitric acid solution in the presence of oxygen at a temperature of 125° C. for about 30 minutes, the reaction being carried out in a closed autoclave with a nitric acid concentration of about 100 to 125 mL nitric acid per 100 g of concentrate and a pulp density of about 150 g/L. The leach slurry is then passed to a liquid-solids separation step 14, and the residue is treated in a second stage leach 16 under substantially the same conditions as the first stage leach 12 except that the nitric acid concentration is increased to 125 to 150 mL nitric acid per 100 g of residue. The second stage leach slurry is passed to a liquid-solids separation step 18, and the leach solution therefrom is recycled to the first stage leach 12. The residue from the second stage leach 16 is discarded as tailings.

The leach solution from the liquid-solids separation step 14, i.e. the first stage leach solution, then proceeds to a silver recovery step 20 where the solution is treated with a slight stoichiometric excess of sodium chloride solution to precipitate the silver as silver chloride. The silver chloride is separated from the solution in a separation step 22 and is heated with sodium carbonate at a temperature of 600° C. for one hour in a conversion step 24 to convert the silver chloride to metallic silver. The reaction products are washed with water in a wash step 26 to dissolve sodium chloride and remaining sodium carbonate, and the silver powder product is separated from the waste water in a separation step 28, the waste water being discarded.

The solution remaining from the separation step 22 is then treated with ammonia solution in a bismuth precipitation step 30 to raise the pH of the solution to a value in the range of 0.4 to 0.98 and precipitate dissolved bismuth as bismuth oxychloride and/or bismuth hydroxide. The bismuth compounds are separated from the solution in a separation step 32 for reprocessing elsewhere.

The solution is then treated with further ammonia solution in an iron-arsenic precipitation step 34 to raise the pH of the solution to a value in the range 0.8 to 1.8 and precipitate iron arsenate. The iron arsenate is separated from the solution in a separation step 36 and may be discarded.

The solution is then treated with ammonia solution to raise the pH to a value in the range of from 5 to 7, and is then treated with ammonium sulphide solution to precipitate dissolved nickel, cobalt, copper and zinc as a mixed sulphide product. The mixed sulphides are separated from the solution in a separation step 40 and are treated elsewhere for the recovery of metals therefrom. The remaining barren liquor may suitable be utilized in a fertilizer plant in view of its content of ammonium nitrate and ammonium sulphate.

Specific examples of various aspects of the invention will now be described.

Specific tests were carried out with various concentrates in which the percentage concentration of various components ranged as follows:

| | |
|---|---|
| Silver | 0.8 to 32.0 |
| Bismuth | 0.2 to 8.0 |
| Iron | 5.0 to 18.0 |
| Arsenic | 0.6 to 7.0 |
| Nickel | 0.2 to 2.0 |
| Cobalt | 0.2 to 1.6 |
| Copper | 0.6 to 7.5 |
| Zinc | 0.2 to 11.0 |
| Sulphur | 5.0 to 18.0 |
| Silicon | 8.0 to 18.0 |
| Lead | 2.0 to 30.0 |
| Calcium | 0.8 to 5.0 |
| Magnesium | 0.7 to 2.7 |
| Aluminum | 1.2 to 4.7 |
| $CO_2$ | 0.5 to 2.3 |

The concentrates tested contained a wide variety of minerals, mainly sulphidic, and elemental silver and bismuth were also present in some cases. Some of the concentrates had particle sizes predominantly less than 325 Tyler screen mesh, others had particle sizes predominantly in the range of 100 to 200 mesh, while others had particle sizes ranging from 28 mesh to less than 325 mesh.

EXAMPLE 1

By using leaching parameters in the manner previously described for the various concentrates in a two-stage leach procedure, it was possible to obtain a leach solution containing over 98% of the silver in the original concentrate in each case.

Typical leach solutions obtained from leaching high and low grade silver concentrates had the following compositions (in g/L):

| | High Grade | Low Grade |
|---|---|---|
| Silver | 22.0 | 3.0 |
| Bismuth | 2.7 | 1.2 |
| Iron | 7.7 | 26.0 |
| Arsenic | 5.3 | 12.7 |
| Nickel | 2.4 | 1.7 |
| Cobalt | 1.9 | 5.3 |
| Copper | 1.1 | 12.2 |
| Sulphur (as sulphate) | 5.3 | 12.7 |

EXAMPLE 2

To precipitate silver chloride from the high grade silver concentrate leach solution mentioned in Example 1, a slight stoichiometric excess of sodium chloride solution was added. Virtually all the dissolved silver precipitated as silver chloride, with the concentration of dissolved silver being reduced from 22 g/L to 0.0024 g/L. Only entrained impurities of other metals were found in the silver chloride precipitate, and these were readily removed by washing with weak nitric acid solution.

Spectrographic analysis of the silver chloride precipitate after nitric acid washing indicated the presence of other elements as follows, with the expression ND meaning not detectable:

| | |
|---|---|
| Bismuth | ND |
| Iron | ND |
| Arsenic | <0.01% |

-continued

| | |
|---|---|
| Nickel | 0.002% |
| Cobalt | ND |
| Copper | 0.001% |
| Zinc | <0.005% |
| Silicon | 0.001% |
| Lead | ND |
| Calcium | ND |
| Magnesium | ND |
| Aluminum | ND |

It will therefore be seen that the precipitated silver chloride is virtually free from all other dissolved metals present in the leach solution.

EXAMPLE 3

Some of the silver chloride precipitate from Example 2 was mixed with a 100% stoichiometric excess of sodium carbonate and the mixture was maintained at a temperature of 600° C. for one hour. After the heat treatment, the mixture was washed with water. The silver powder product was subjected to spectrographic analysis, with the same results as for the silver chloride precipitate given in Example 2. The silver powder had an apparent density of 2.5 g/cc with a Fisher number of 13.0. Chemical analysis of the silver powder showed that the powder had an oxygen content of less than 0.01%, with about 0.002% carbon, 0.001% sulphur and 0.12% chlorine. The purity of the silver powder produced in this manner is therefore self-evident.

EXAMPLE 4

Silver-free leach solutions from various tests conducted in accordance with Example 2 were combined to produce a head solution having the pH and metal contents given in the following Table 1.

TABLE 1

| | Bi | Fe | As | Ni | Co | Cu | Zn |
|---|---|---|---|---|---|---|---|
| Head Solution | 8.4 | 35.3 | 21.4 | 2.3 | 8.4 | 15.3 | 2.7 |
| Bismuth Precipitate | 40.7 | 8.0 | 8.2 | — | — | 0.12 | — |
| Iron-Arsenic Precipitate | 2.9 | 26.3 | 20.0 | — | — | 0.6 | — |
| Mixed Sulphides Precipitate | <0.01 | 1.1 | 1.3 | 2.6 | 8.8 | 15.9 | 3.1 |

Ammonia was added to first raise the pH from 0.2 to 0.6, and the resulting bismuth compound precipitated was separated. Ammonia was then added to raise the pH to 1.8, and the resulting iron-arsenic compound precipitated was separated. The remaining solution was then treated with further ammonia and with ammonium sulphide to raise the pH to 5 and precipitate a nickel-cobalt-copper-zinc sulphide precipitate, which was separated from the final solution. The various precipitates were analyzed, and the results are also shown in Table 1, which clearly shows the selective precipitation of the various elements concerned. The solution contents are given as g/L and the precipitate contents are given as percentages. Blanks in the table indicate that the element concerned was not present in an analyzable quantity.

The advantages of the invention are therefore readily apparent from the foregoing description. Substantially all the silver in complex silver containing material which also contains arsenic and iron can be extracted by nitric acid leaching which also extracts almost all other metals. Even though the leach solution contains many other dissolved elements in addition to silver, silver can be selectively precipitated by the use of chloride ions. Other metals can also be recovered in a satisfactory manner from the solution and most of the arsenic can be precipitated in a relatively harmless form as iron arsenate. Some of the arsenic is also present in the mixed sulphides product where it can be dealt with in known manner.

Other examples and embodiments of the invention will be apparent to a person skilled in the art, the scope of the invention being defined in the appended claims.

What I claim as new and desire to protect by Letters Patent of the United States is:

1. A process for the recovery of silver values from silver-containing material which also contains bismuth, iron and arsenic, said process comprising leaching the material under oxidizing conditions at elevated temperature and pressure in aqueous nitric acid solution to dissolve a substantial amount of silver together with substantial amounts of bismuth, arsenic, and iron, the amount of nitric acid used in said leaching being sufficient to provice nitrate ions at least stoichiometrically equivalent to the dissolved metal ions in the leach solution, separating resultant leach solution from undissolved leach residue, treating the leach solution with a solution containing chloride ions to selectively precipitate substantially all dissolved silver as silver chloride without significant coprecipitation of other dissolved metals, separating the silver chloride precipitate from the remaining solution, raising the pH of the solution to a value in the range of from about 0.4 to about 0.8 to precipitate a bismuth compound, and separating the bismuth compound from the remaining solution.

2. A process according to claim 1 wherein the leach step is carried out at a temperature in the range of from about 50° C. to about 125° C.

3. A process according to claim 1 wherein the leach step is carried out in first and second stages, with undissolved residue from the first stage being subjected to the second stage, and leach solution from the second stage being recycled to the first stage.

4. A process according to claim 1 wherein the silver chloride precipitate is mixed with sodium carbonate and heated at a temperature in the range of from about 500° C. to about 650° C. to reduce the silver chloride to elemental silver powder.

5. The process according to claim 1 wherein the pH of the remaining solution is raised to a value in the range of from about 0.8 to about 1.8 to precipitate an iron-arsenic compound, and said iron-arsenic compound is separated from the remaining solution.

6. A process according to claim 1 wherein the solution also contains at least one dissolved metal selected from the group consisting of nickel, cobalt, copper and zinc, and the pH of the remaining solution is raised to a value in the range of from about 5 to about 7 and the solution is treated with a sulphide selected from the group consisting of ammonium sulphide, hydrogen sulphide and alkali metal sulphides to precipitate said at least one dissolved metal as a sulphide product and the sulphide product is separated from the solution.

7. A process according to claim 1 wherein nitric oxide produced during the leaching stage is recovered therefrom and separately treated with oxygen to produce nitrogen peroxide, the nitrogen peroxide then being dissolved in aqueous solution to produce nitric acid.

8. A process according to claim 1 wherein the pH of the solution is raised by the addition of ammonia to a value in the range of from about 0.4 to about 0.8 to precipitate the bismuth compound.

* * * * *